US011060362B2

(12) United States Patent
Perez

(10) Patent No.: US 11,060,362 B2
(45) Date of Patent: Jul. 13, 2021

(54) SELF-ADJUSTING PIPE SPINNER

(71) Applicant: Hawk Industries, Inc., Signal Hill, CA (US)

(72) Inventor: Raul H. Perez, Hawthorne, CA (US)

(73) Assignee: Hawk Industries, Inc., Signal Hill, CA (US)

( * ) Notice: Subject to any disclaimer, the term of this patent is extended or adjusted under 35 U.S.C. 154(b) by 114 days.

(21) Appl. No.: 16/049,554

(22) Filed: Jul. 30, 2018

(65) Prior Publication Data

US 2018/0355685 A1 Dec. 13, 2018

Related U.S. Application Data

(63) Continuation of application No. 14/816,619, filed on Aug. 3, 2015, now Pat. No. 10,036,216, which is a continuation of application No. 12/480,592, filed on Jun. 8, 2009, now Pat. No. 7,876,108.

(60) Provisional application No. 61/059,673, filed on Jun. 6, 2008.

(51) Int. Cl.
*E21B 19/16* (2006.01)

(52) U.S. Cl.
CPC ..... *E21B 19/164* (2013.01); *E21B 19/161* (2013.01); *E21B 19/168* (2013.01)

(58) Field of Classification Search
CPC ..... E21B 19/16; E21B 19/165; E21B 19/164; E21B 19/168; E21B 19/08; E21B 19/00; E21B 19/06; E21B 19/087
See application file for complete search history.

(56) References Cited

U.S. PATENT DOCUMENTS

2005/0047884 A1* 3/2005 Belik ..... E21B 19/00 408/234

* cited by examiner

*Primary Examiner* — Yong-Suk (Philip) Ro
(74) *Attorney, Agent, or Firm* — Avyno Law P.C.

(57) ABSTRACT

A self-adjusting spinner is provided that is capable of accommodating various pipe sizes without requiring the need for an operator to climb up the support mechanism and manually change the position of the drive assembly. The self-adjusting spinner includes a case having two pivotally connected members: a stationary case member and a moving case member. Upper and lower plates having gear racks are mounted on the stationary case member for moving a drive assembly horizontally across the case. The drive assembly includes a motor that drives gear sprocket through a drive shaft. The drive sprocket then drives a chain that rotates a drill pipe in an operative position relative to the case. The spinner also includes an adjusting assembly mounted on the case that moves the drive assembly along the gear rack upon the actuation of an adjustment sequence. When the adjustment sequence is initiated, the effective length of the chain is adjusted to accommodate drill pipes of varying diameters.

12 Claims, 8 Drawing Sheets

SELF-ADJUSTING PIPE SPINNER

RELATED APPLICATIONS

This application claims priority of U.S. Provisional Application No. 61/059,673, filed on Jun. 6, 2008, titled SELF-ADJUSTING PIPE SPINNER, which application is incorporated in its entirety by reference in this application.

BACKGROUND OF THE INVENTION

1. Field of the Invention

The present invention generally concerns tooling and equipment utilized in the maintenance and servicing of oil and gas production wells, and more particularly relates to a power tong of the type utilized in conjunction with back-up tongs or wrenches to make or break threaded joints between successive tubing elements that extending through a well bore into underground deposits.

2. Related Art

In drilling for oil and gas, it is necessary to assemble a suing of drill pipe joints. Thus, a tubular drill string may be formed from a series of connected lengths of drill pipe and suspended by an overhead derrick. These lengths of drill pipe are connected by tapered external threads (the pin) on one end of the pipe, and tapered internal threads (the box) on the other end of the pipe.

During the drilling and completion of a well, as the well is drilled deeper, additional joints of pipe are periodically added to the drill string and, as the drill bit at the end of the drill string is worn, the drill string must occasionally be pulled from the well and reinstalled for maintenance purposes. The process of pulling or installing the drill string is referred to as "tripping." During tripping, the threaded connections between the lengths of drill pipe are connected and disconnected as needed. The connecting and disconnecting of adjacent sections of drill pipe (referred to as making or breaking the connection, respectively), involves applying torque to the connection and rotating one of the pipes relative to the other to fully engage or disengage the threads.

In modern wells, a drill string may be thousands of feet long and typically is formed from individual thirty-foot sections of drill pipe. Even if only every third connection is broken, as is common, hundreds of connections have to be made and broken during tripping. Thus, the tripping process is one of the most time consuming and labor intensive operations performed on the drilling rig.

Currently, there are a number of devices utilized to speed tripping operations by automating or mechanizing the process of making and breaking a threaded pipe connection. These devices include tools known as power tongs, iron roughnecks, and pipe spinners. Many of these devices are complex pieces of machinery that require two or more people to operate and require multiple steps, either automated or manual, to perform the desired operations. Additionally, many of these devices grip the pipe with teeth that can damage the drill pipe and often cannot be adjusted to different pipe diameters without first replacing certain pieces, or performing complex adjustment procedures.

In particular, roughnecks combine a torque wrench and a spinning wrench, simply called a spinner, to connect and disconnect drill pipe joints of the drill string. In most instances, the spinner and the torque wrench are both mounted together on a carriage. To make or break a threaded connection between adjoining joints of drill pipe, certain roughnecks have a torque wrench with two jaw levels. In these devices, an upper jaw of the torque wrench is utilized to clamp onto a portion of an upper tubular, and a lower jaw clamps onto a portion of a lower tubular (e.g., upper and lower threadedly connected pieces of drill pipe). After clamping onto the tubular, the upper and lower jaws are turned relative to each other to break or make a connection between the upper and lower tubulars. A spinner, mounted on the carriage above the torque wrench, engages the upper tubular and spins it until it is disconnected from the lower tubular (or in a connection operation, spins two tubulars together prior to final make-up by the torque wrench).

Generally, a spinner comprises four rollers, each driven by a separate hydraulic motor, that engage the outer wall of the drill pipe to spin the pipe. However, other spinners exists that use flexible belts or chains to engage and spin the pipe. An example of a chain spinner is the SPINMASTER® spinner made available from Hawk Industries. The basic function and construction of the SPINMASTER® spinner are disclosed in U.S. Pat. No. 4,843,924 (Hauk).

In particular, the Hauk '924 patent discloses a spinner that includes first and second elongate casing sections that are pivotally connected to each other at a pivot, and first and second driven sprockets mounted, respectively, on the casing sections at locations remote from the pivot. The spinner also includes a drive sprocket, mounted on the first casing section, driven by a motor-gear assembly and a continuous chain mounted around the drive sprocket, and around the first and second driven sprockets. The chain has an inverse internal portion adapted to receive and directly contact a tubular well element to be rotated. Cylinders connected between the casing sections pivot them toward and away from each other and thus, alternately clamp the inverse internal portion around the well element, and release such element from the inverse internal portion of the chain.

Some prior art spinners, such as the SPINMASTER®, are also adjustable to accommodate pipes of varying diameter. These spinners are adjusted by changing the location of the drive sprocket relative to the driven sprockets, thus the effective length of the chain is adjusted to accommodate different pipe diameters. While adjustable spinners are versatile, these spinners must be manually adjusted by the operator during use. In many instances, the operator must climb atop of the spinner, disengage fasteners or locking pins holding the drive sprocket in place, manually adjust the drive sprocket to a desired location, and re-fasten or lock the drive sprocket at its new location. Manually adjusting the spinner can therefore be consuming and dangerous.

Thus, a need exists for an automated spinner that allows the operator to change the pipe size of the spinner from a remote location to provide a safer and quicker pipe change.

SUMMARY

A self-adjusting spinner is provided that is capable of accommodating various pipe sizes without requiring the need for an operator to climb up the support mechanism and manually change the position of the drive assembly. The self-adjusting spinner includes a case having two pivotally connected members: a stationary case member and a moving case member. Upper and lower plates having gear racks are mounted on the stationary case member for moving a drive assembly horizontally across the case. The drive assembly includes a motor that drives gear sprocket through a drive shaft. The drive sprocket then drives a chain that rotates a drill pipe in an operative position relative to the case. The spinner also includes an adjusting assembly mounted on the case that moves the drive assembly along the gear rack upon the actuation of an adjustment sequence. When the adjustment sequence is initiated, the effective length of the chain is adjusted to accommodate drill pipes of varying diameters.

In another aspect of the invention, a method for operating a pipe spinner having a chain positioned inside a case is provided. The method includes the steps of receiving a pipe within the case, where the case has a stationary member and a movable arm member pivotally connected to the stationary member, pivoting a moving arm member toward the stationary member to surround the pipe with the chain, and applying tension to the chain by remotely engaging a drive assembly on the case that is moveable relative to the stationary member.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
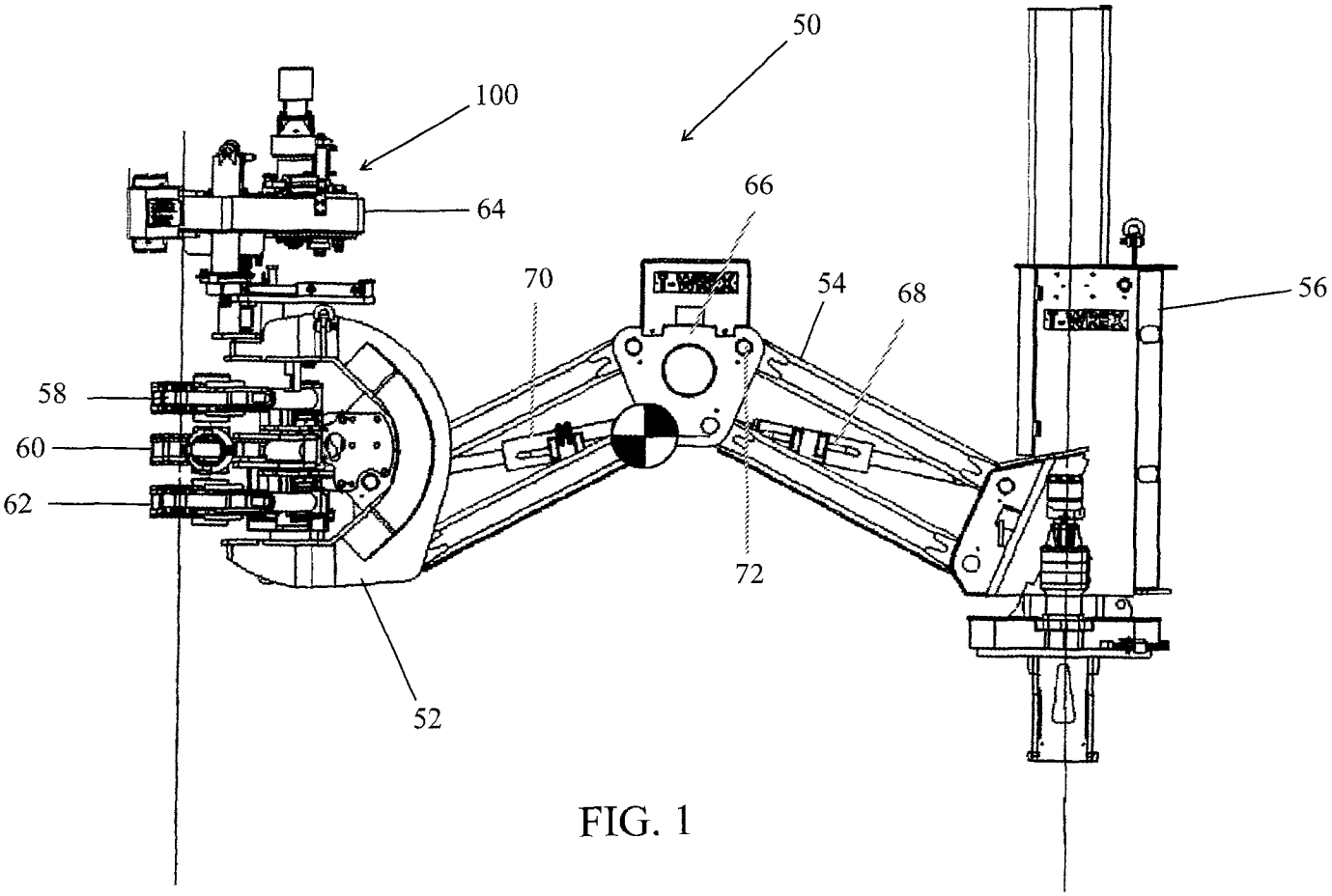
FIG. 1 is a side view of a drill pipe making and breaking apparatus that incorporates a self-adjusting pipe spinner of the invention.

The present invention is directed to a chain spinner that can be a free hanging, separate stand alone unit, or part of a drill pipe making and breaking apparatus such as the T-WREX JR. 51200 apparatus, available from Hawk Industries, Inc. of Long Beach, Calif., as depicted in FIG. 1. The apparatus, referred to herein as a roughneck 50, includes a structural frame 52 that is moveably coupled to a vertical translator 56 via an extending arm 54. The vertical translator 56 is configured to move the structural frame 52 up and down relative to a drill string, and the extending arm 54 is configured to move the structural frame 52 towards and away from the drill string. The structural frame 52 carries a wrench assembly that includes a top wrench 58, a middle wrench 60, and bottom wrench 62, and a spinner 100. The wrenches 58, 60, 62 are configured to hold a pipe section of the drill string while the spinner 100 spins an adjoining pipe section of the drill string to make or break the drill string.

FIG. 1 illustrates one implementation of an embodiment of a self-adjusting spinner 100 of the present invention. As illustrated in FIG. 1, the self-adjusting spinner 100 includes a case assembly 200, a moveable drive assembly 400, a motor adjustment assembly 500, and a continuous roller chain 302. The case assembly 200 includes a stationary case member 210 and a moving arm case member 240. The stationary case and moving arm case members 210, 240 are configured to enclose the roller chain 302.

As shown in FIG. 1, the extending arm 54 may include a transfer joint 66, a pivotal joint 72, a first piston 68 and a second piston 70. As also shown in FIG. 1, the first piston 68 may extend between the vertical translator 56 and the transfer joint 66 while the second piston may extend between the structural frame 52 and the transfer joint 66.

Figure 3:
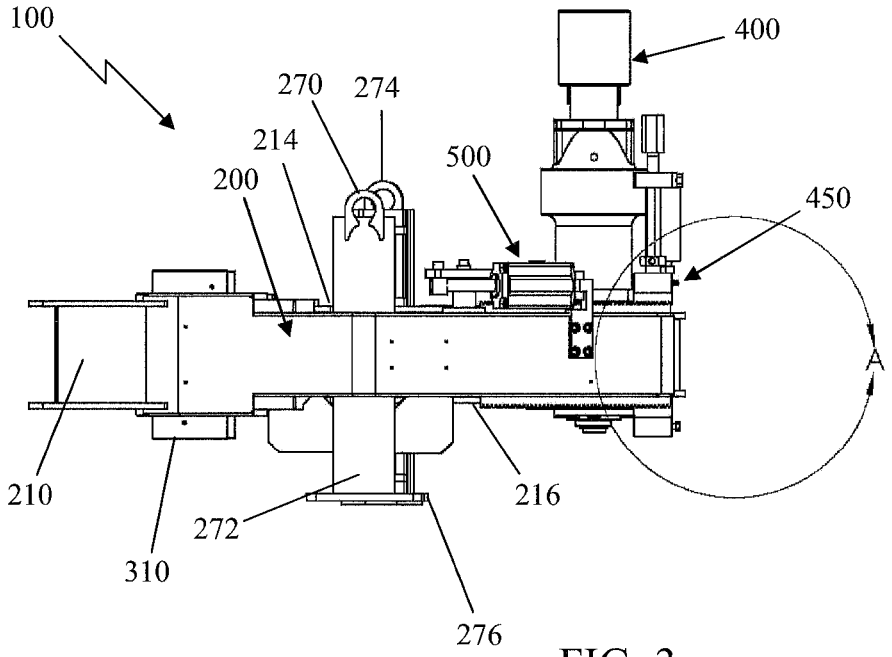
FIG. 3 is a side view of the self-adjusting spinner of FIG. 2.
Figure 4:
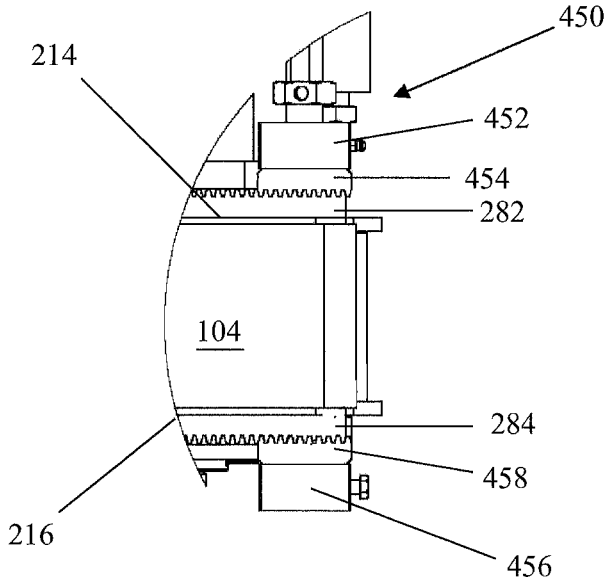
FIG. 4 is an enlarged side view of the rear of the case of the self-adjusting spinner of FIG. 3, illustrating the engagement of the motor clamp assembly on the rear of the case.

Referring now to FIG. 4, the stationary case member 210 includes an elongated sidewall 212 coupled between an upper gear mount plate 214 and a lower gear mount plate 216 (FIG. 3). The sidewall 212 and the upper and lower gear mount plates 214, 216 define a substantially U-shaped channel for receiving the roller chain 302.

The upper gear and lower mount plates 214, 216 include a corresponding pair of drill holes (not shown), corresponding elongated openings 218 that extend longitudinally along a central portion of the mount plates, and corresponding arcuate surfaces 222 and semi-circular cut-outs 224 (FIG. 5) located near the front of the case assembly 200. The elongated openings 218 are configured to receive a base portion of the drive assembly 400, such that the drive assembly 400 may be moveable along the length of the openings 218.

Now turning to the moving arm member 240, this member includes an elongated sidewall 242 coupled between an upper mount plate 244 and lower mount plate 246. The sidewall 242 and the upper and lower mount plates 244, 246 define a substantially U-shaped channel for receiving the roller chain 302.

The upper and lower gear mount plates 214, 216 of the stationary case member are configured to engage the upper and lower mount plates 244, 246 of the moving arm case member 240 as the moving arm case member 240 is rotated towards the stationary case member 210. The upper and lower mount plates 244, 246 include a corresponding pair of drill holes 248, and corresponding arcuate surfaces 250 and semi-circular cut-outs 252 located near the front of the case assembly 200.

According to an implementation of the invention, all or a portion of the casing assembly 200 may be constructed from durable metal. For example, in one implementation all or a portion of the case assembly 200 may be constructed from mild steel. Further, the case assembly may be manufactured by a variety of means. For example, in one implementation the mounting plates and sidewalls of the case assembly may be integrally formed, or laser cut, formed, and welded together on the tooling gig. Alternatively, the sidewalls may be fastened to the mounting plates by, for example, rivets, bolts, or any other suitable fasteners.

Figure 5:
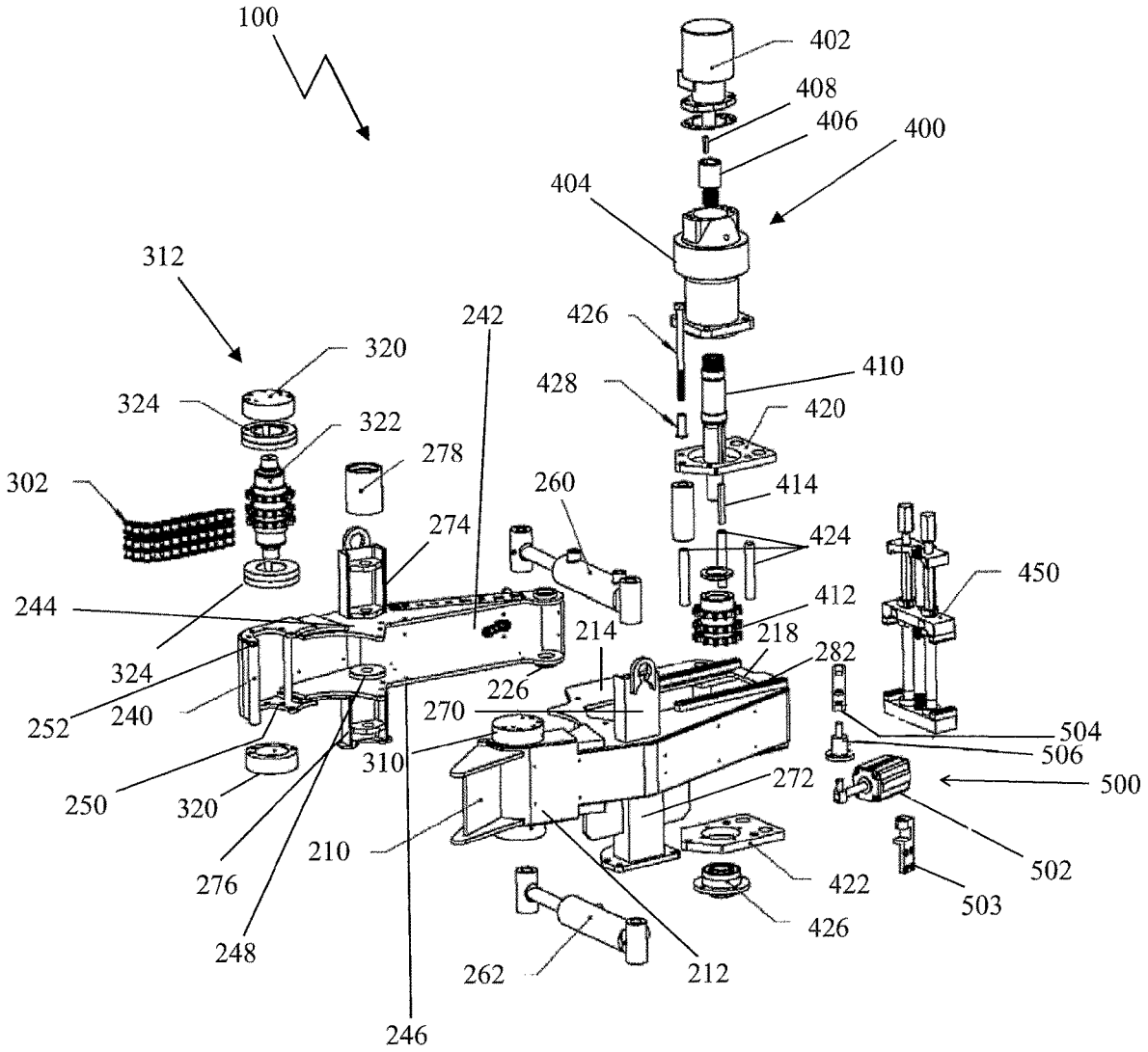
FIG. 5 is an exploded perspective view of the self-adjusting spinner of FIG. 2.
Figure 6:
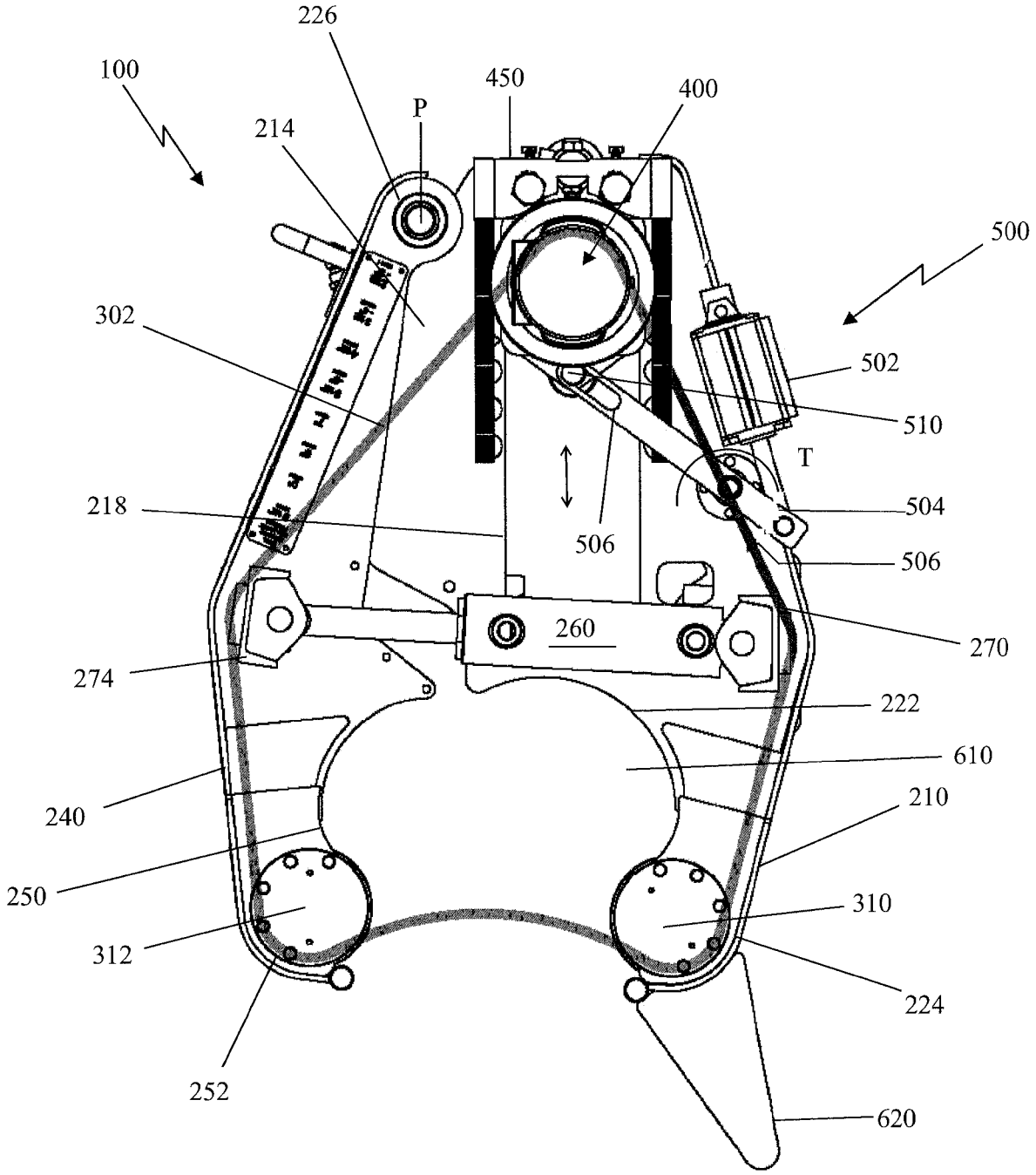
FIG. 6 is a top view of the self-adjusting spinner of FIG. 2 positioned at a setting designed to receive a small diameter pipe, highlighting the position of the roller chain and the spinner motor assembly.
Figure 7:
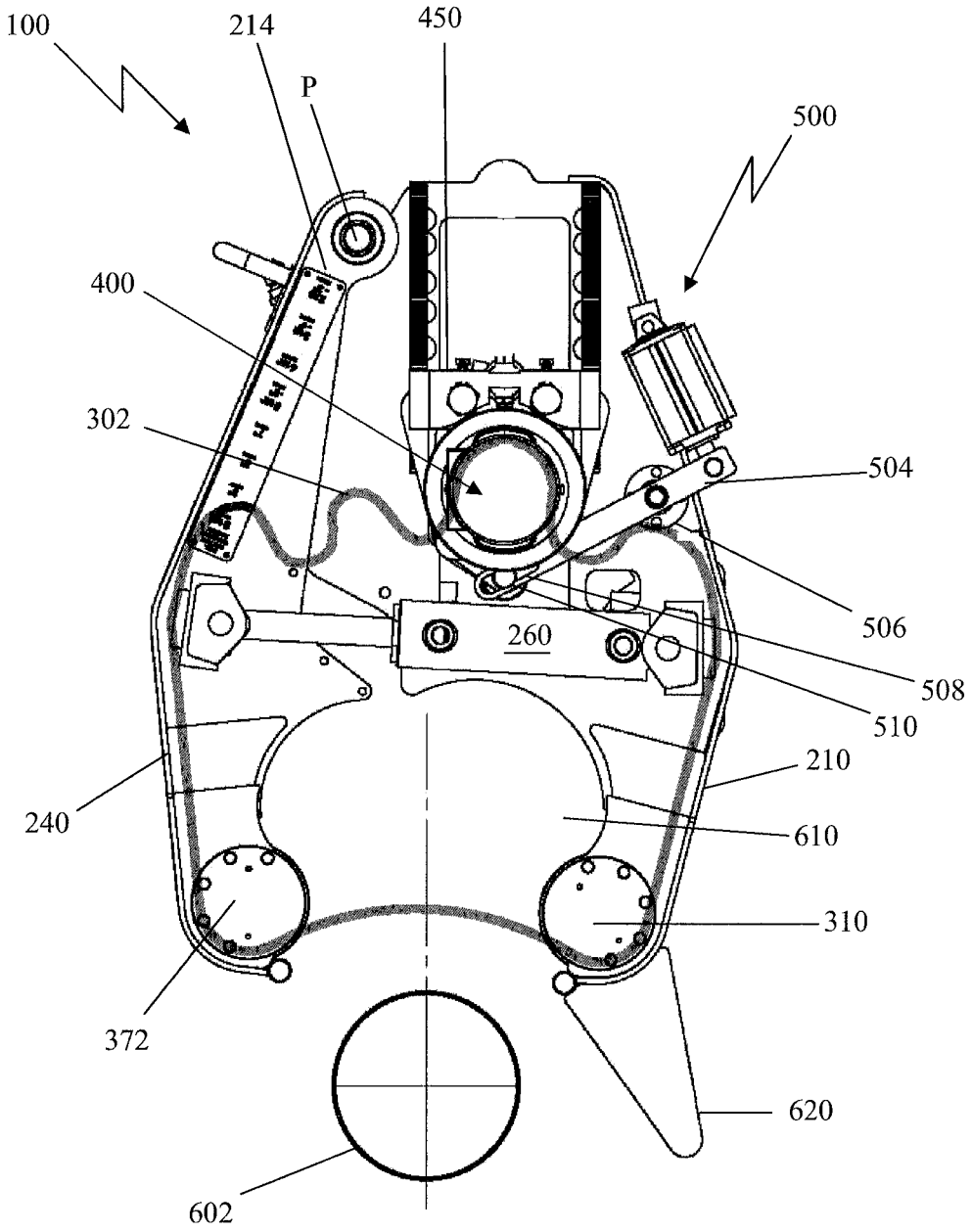
FIG. 7 is a top view of the self-adjusting spinner of FIG. 6 illustrated after the spinner motor assembly has been adjusted to receive a larger diameter pipe, highlighting the position of the roller chain and the spinner motor assembly after adjustment.
Figure 8:
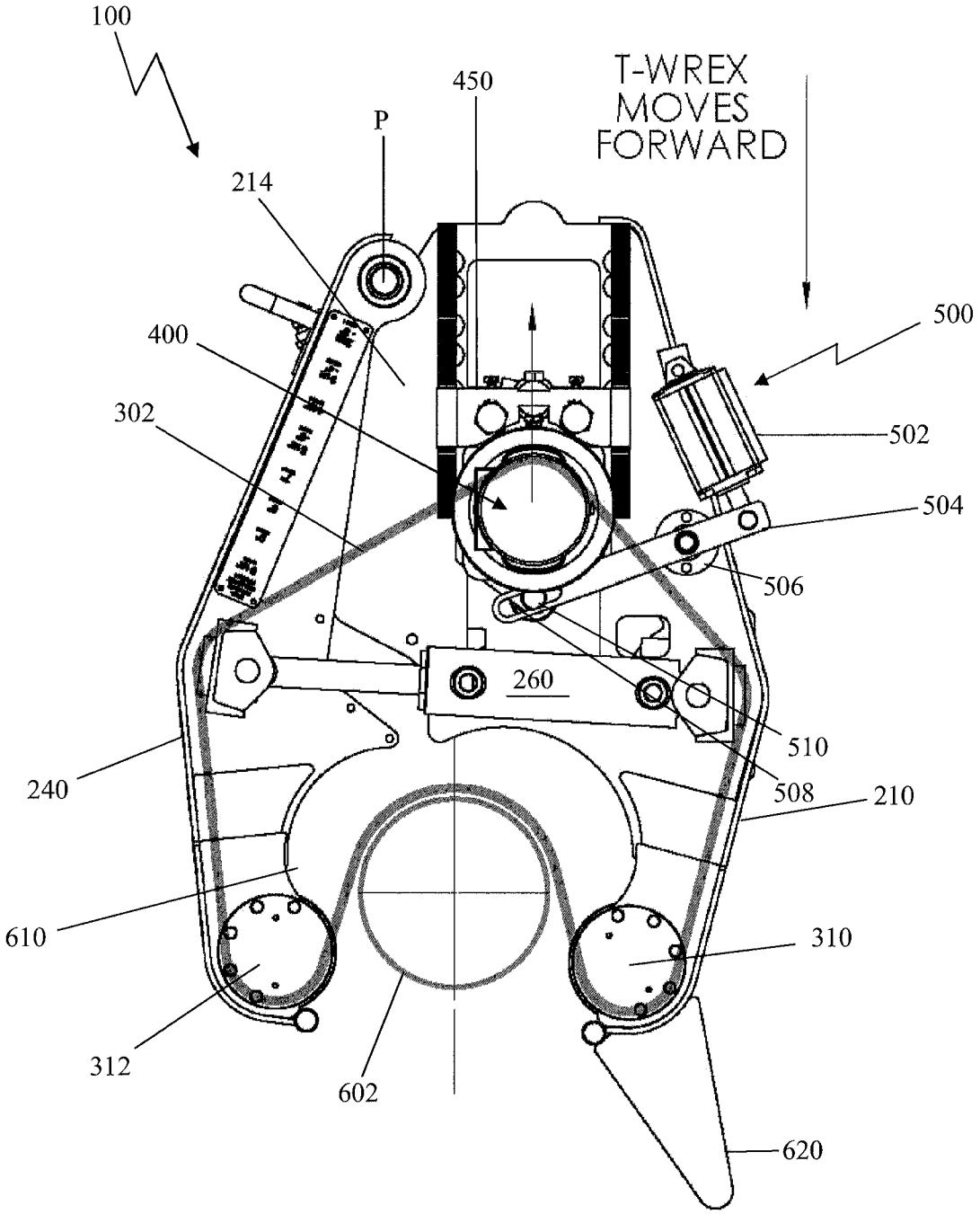
FIG. 8 is a top view of the self-adjusting spinner of FIG. 7 illustrated after a pipe has been inserted in the spinner and the slack in the roller chain has been removed, highlighting the position of the roller chain, pipe, and the spinner motor assembly after adjustment.
Figure 9:
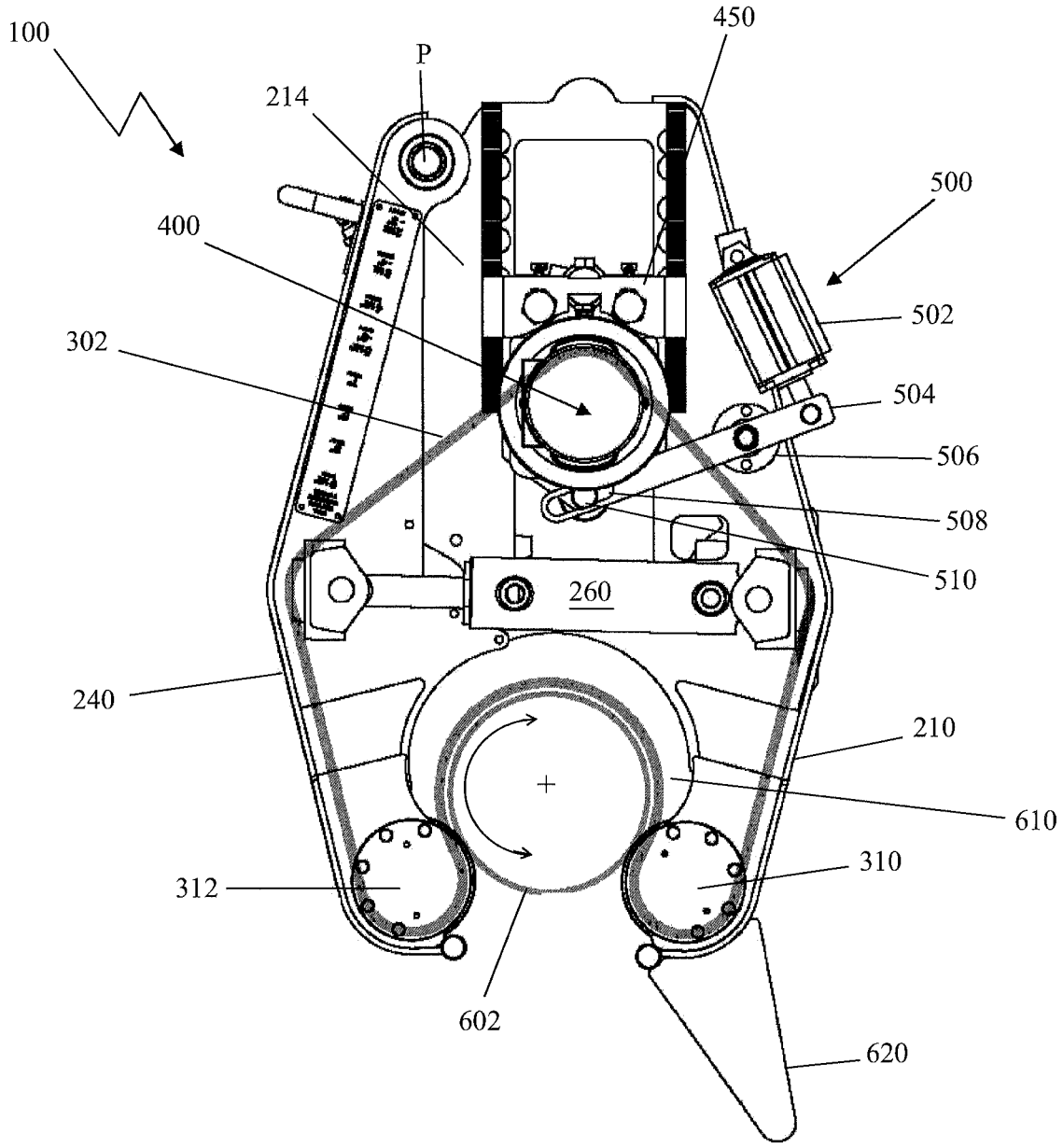
FIG. 9 is a top view of the self-adjusting spinner of FIG. 6 illustrated after the pipe has been positioned in the self-adjusting spinner and the case assembly has been closed around the pipe, highlighting the position of the roller chain and the spinner motor assembly after adjustment.

As best shown in FIG. 5, the moving arm case member 240 is rotatably coupled to the stationary case member 210 at a pivot P (FIG. 5) near the rear of the case assembly 200, such that the moving arm case member 240 is able to move toward and away from the stationary case member 210 to engage a pipe 602 positioned in the case assembly 200, as illustrated in FIGS. 6-8 below. The moving arm case member 240 and the stationary case member 210 are coupled together by a bolt and lock nut assembly that extends through a corresponding pair of bores 226 located at rear ends of the moving arm and stationary case members 240, 210.

Now turning back to FIG. 4, the moving arm case member 240 is moved toward and away from the stationary case member 210 by an upper grip actuator 260 and a lower grip actuator 262. In one implementation, the grip actuators 260, 262 are linear double acting hydraulic cylinders, but it would be obvious to one skilled in the art that any suitable actuator may be applied.

In this example, the upper grip actuator 260 is rotatably mounted horizontally across the case assembly 200 at one end by an upper mounting support 270 positioned on the stationary case member 210 and, at the other end, by a second upper mounting support 274 positioned on the moving arm case member 240. The lower grip actuator 262 is rotatably mounted horizontally across the case assembly 200 at one end by a lower mounting support 272 positioned on the underside of the stationary case member 210 and, at the other end, by a second lower mounting support 276 positioned on the underside of the moving arm case member 240. The grip actuators 260, 262 are mounted to the mounting supports 270, 272, 274, 276 by retaining bolt and lock nut assemblies extending through the ends of the actuators. These retaining bolts also extend through idler rollers 278 positioned between the mounting supports 270, 272, 274, 276.

As will be described in more detail below, the upper and lower grip actuators 260, 262 are generally maintained in an open (or fully extended) position to receive the pipe 602 within the case assembly 200. Once the pipe 602 is positioned within the case assembly 200, the grip actuators 260, 262 are activated to move the moving arm case member 240 towards the stationary case member 210 to grip the pipe 602.

The idler rollers 278 correspond with and are disposed between corresponding drill holes 228 in the moving arm and stationary case members 240, 210. The idler rollers 278 are free to rotate relative to the moving arm and stationary case members 240, 210 and are maintained in spaced apart relation from the sidewalls 212, 242 to form a passage for passing the chain 302 therethrough. The idler rollers 278 are adapted to slidably engage the roller chain 302 as it rotates within the case assembly 200. In an implementation, the idler rollers 278 may be made from heat treated alloy steel or any other durable metal.

Driven roller assemblies 310, 312 are positioned in the semi-circular cut-outs 224, 252 at ends of the stationary and moving arm case members 210, 240 opposite the pivot P. The driven rollers 310, 312 attached to the stationary and moving arm case members 210, 240 are free to rotate relative thereto. Each roller 310, 312 includes a pair of bearing caps 320 that retain a roller sprocket 322 that is rotatably coupled between a pair of roller bearings 324. The roller sprocket 322 includes a body carrying a series of teeth for engaging the chain 302 and driving it about the rollers 310, 312 to spin a pipe positioned between the driven rollers 310, 312 when the roller chain 302 is wrapped about the pipe, as illustrated in FIGS. 6-8 below.

Movement of the roller chain 302 is driven by the drive assembly 400. The drive assembly 400 includes a gear motor 402 mounted on a planetary gear reducer 404. In one example, the gear motor 402 may be a hydraulic motor, an air motor, or any other suitable driving mechanism. In one implementation, a gear 406 is coupled between the gear motor 402 and the rear reducer 404 to increase the torque transferred from the gear motor 402 to a drive shaft 410 coupled to the gear reducer 404 at an end opposite the motor 402. The gear 406 is retained inside of an upper portion of the gear reducer 404 by a gear key 408.

In this way, the gear motor 402 drives the planetary gear reducer 404, which in turn drives a drive sprocket 412 coupled to an end of the drive shaft 410 opposite the gear reducer 404. In one implementation, the drive sprocket 412 is secured to the drive shaft 410 by a sprocket key 414. The drive sprocket 412 carries teeth that engage (mesh) the links of the roller chain 302 to drive the roller chain 302 through the driven rollers 310, 312, respectively positioned at an end of the case assembly 200 opposite the drive assembly 400.

The upper and lower gear mount plates 214, 216 of the stationary case member 210 are configured to movably retain the drive assembly 400 against the case assembly 200. In one implementation, the drive assembly 400 is retained within the elongated openings 218 of the upper and lower gear mount plates 214, 216 by a pair of gear mounts 420, 422 that movably abut the upper and lower gear mount plates 214, 216. In this implementation, gear mount 420 supports the gear reducer 404, as gear mounts 420 and 422 are coupled together by fasteners that extend through a set of spacers 424 fastened between the gear mounts 420, 422. The gear mounts 420, 422 are configured to ride between a set of upper and lower fixed racks 282, 284 axially mounted to the upper and lower gear mount plates 214, 216 about elongated openings 218. The fixed racks 420, 422 may be secured to the upper and lower gear mount plates 214, 216 by screws, bolts, rivets, or any kind of industrial fastener. In one implementation, spacers 420, 422 may be configured such that the contact surfaces of gear mounts 420, 422 and the upper and lower fixed racks 282, 284 are maintained within a spaced relationship of approximately 0.050 inches. A drive shaft bearing 426 is further attached to gear mount 422 to support the drive shaft 410 of the drive assembly 400.

Figure 2:
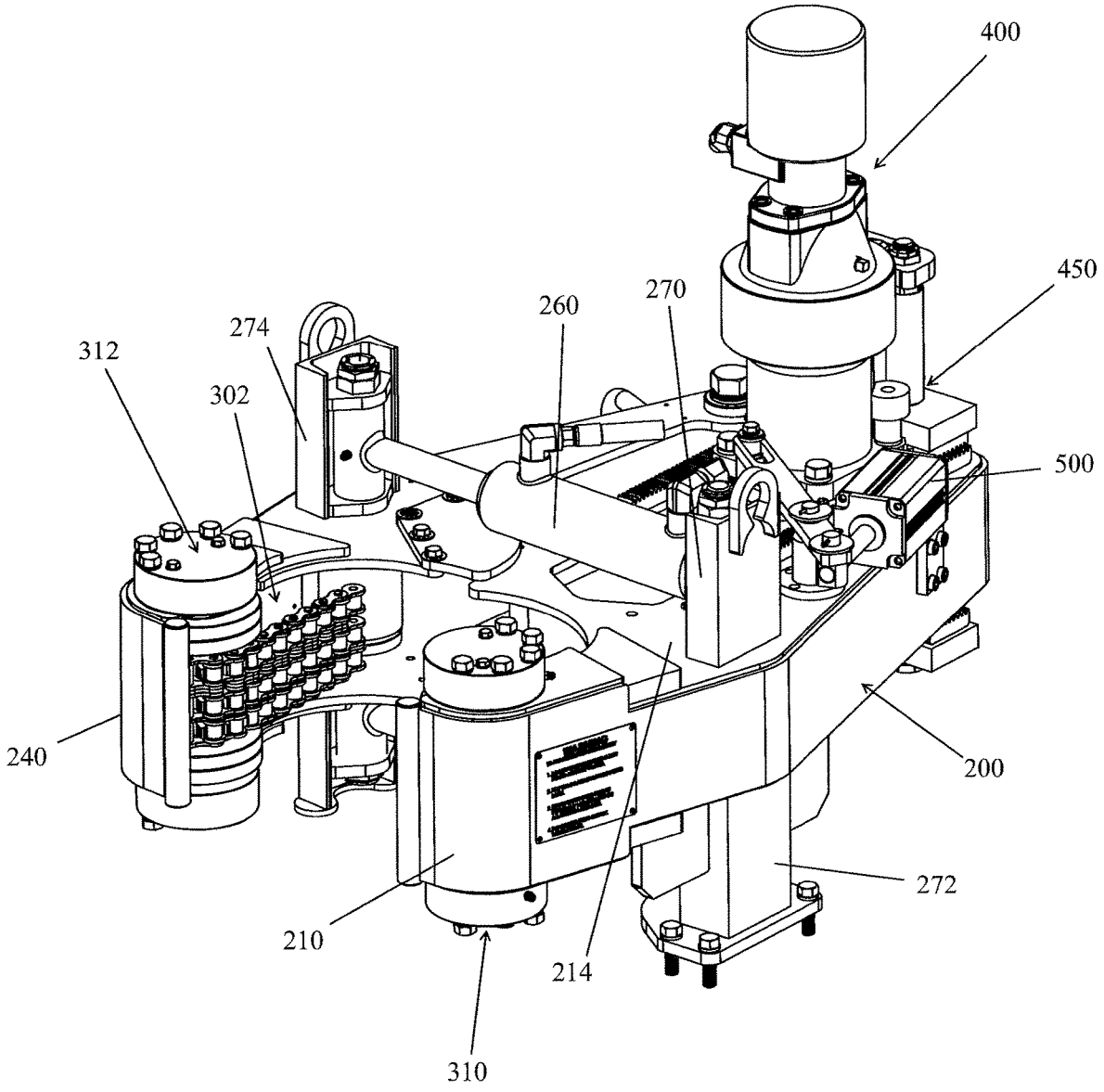
FIG. 2 is a perspective view of one example of an implementation of a self-adjusting spinner of the invention.

The drive assembly 400 is adjustably secured to the stationary case member 210 by a motor clamp assembly 450 attached to a rear end of the drive assembly 400. As illustrated in FIGS. 2-4, the motor clamp assembly 450 includes a hydraulic cylinder (not shown) that activates a set of upper and lower rack clamps 452, 456 that compliment the upper and lower fixed racks 282, 284. As better illustrated in FIG. 3, each rack clamp 452, 456 includes a set of toothed feet 454 and 458 that mesh with a complimentary set of teeth carried by the upper and lower fixed racks 282, 284. Thus, when the hydraulic cylinder activates the upper and lower rack clamps 452, 456, the rack clamps 452, 456 may be moved towards each other to engage (mesh) the rack clamps 452, 456 with the respective fixed racks 282, 284 to secure the drive assembly 400 to case assembly 200 and provide a positive lock. The positive lock prevents movement of the drive assembly 400 within the elongated openings 218.

In the alternative, the hydraulic cylinder of the motor clamp assembly 450 may cause the upper and lower gear rack clamps 452, 456 to move away from each other to disengage the rack clamps 452, 456 from the fixed gear racks 282, 284, to an unlocked position. When in the unlocked position, the drive assembly 400 is released from case assembly 200 and the drive assembly 400 may be moved relative to the fixed racks 282, 284 to change the effective chain engagement length. (It can be slid parallel to the fixed racks 282, 284, within the elongated opening 218.) When the drive assembly 400 is in the new desired position, the operator sends a signal to the hydraulic cylinder of the motor clamp assembly 450 to lock the movable gear rack clamps 452, 456 in the new position (by the engaging the gear rack teeth). Because the gear racks 282, 284 are securely mounted to the stationary case member 214, the drive assembly 400 is prevented from slipping while it is in the locked position.

Referring to FIG. 5, the motor adjustment assembly 500 is provided for adjusting the position of the drive assembly 400 along the elongated openings 218 of the case assembly 200. The motor adjustment assembly 500 includes an adjusting actuator 502 that is secured to one end of a pivot arm 504. In one implementation, the actuator 502 may include an air cylinder, a hydraulic cylinder, or any other suitable actuating device. The adjusting actuator 502 is secured to the case assembly 200 by a mount 503 attached to the sidewall 212 (FIG. 1) of the stationary case member 210.

The pivot arm 504 pivots about a pivot arm mount 506 attached to the upper gear mount plate 214. The pivot arm 504 also carries an elongated slot 508 at an end opposite the adjusting actuator 502 that slidably engages a slide pin 510 coupled to a front end of the drive assembly 400. In this configuration, the adjusting actuator 502 applies force to an end of the pivot arm 504 to rotate the arm 504 about the pivot arm mount 506, thus generating torque about the pivot mount 506. The torque generated by the adjusting actuator 502 is applied to the slide pin 510 to move the drive assembly 400 forwards and backwards within the elongated openings 218. While a lever mechanism is presently described, other mechanisms and implementations may be used to adjust the position of the drive assembly 400 in accordance with the present invention.

As illustrated in FIGS. 5 through 8, the roller chain 302 is a continuous chain that runs around the driven rollers 310, 312, the idler rollers 278, the drive sprocket 412, and around the pipe 602 (see FIGS. 6-8). According to one implementation, the roller chain 302 is driven by the drive sprocket 412 and configured to grip a pipe 602 without damaging its outer surface and provides sufficient friction to rotate the pipe 602 within the case assembly 200 as desired.

The length of the roller chain 302 and the position of the idler rollers 310, 312 and their respective roller sprockets 322 result in the chain 302 having an inverse internal portion. This inverse internal portion wraps around a pipe 602 (see FIGS. 6-8) inserted in the front opening of the case assembly 200 when the moving case member 240 closes relative to the stationary case member 210, thereby enabling the chain 302 to grip the circumference of the pipe 602 and spin it.

The effective length of the roller chain 300 on the pipe 602 can be adjusted by repositioning the drive assembly 400 (or more particularly the drive sprocket 412) relative to the pipe 602 (or the driven rollers 310, 312) via the motor adjustment assembly 500, as discussed above. The repositioning is used to accommodate pipes 602 of different diameters, to compensate for chain "stretch" as the chain wears, and to adjust the chain gripping tension on the pipe 602. In one implementation, the roller chain 302 may be adjustable to accommodate pipes having diameters from 3 to 9½ inches and the chain may be a heavy-duty, durable roller-style chain having eight-eight links and one inch pitch.

Operation

In operation, as illustrated in FIGS. 5-8, the moving arm case member 240 may be opened and closed relative to the stationary case member 210. The accurate surfaces 222, 250 of the stationary case member 210 and the moving arm case member 240 correspond to define a well 610 for receiving a section of the pipe 602. A guide 620 mounted to the front end of the stationary case member 210 is configured to engage the drill pipe 602 if the spinner 100 is misaligned with the drill pipe 602 when the spinner 100 approaches the pipe. If the spinner is misaligned, the guide 620 will contact the pipe 602 to pivot and align the spinner 100 with the pipe 602 as the spinner 100 moves towards it.

When an operator wishes to make or break a drill string section, the operator may move a roughneck carrying the spinner 100 towards a drill string. Depending on the drill pipe diameter, the operator may desire to adjust the spinner 100 to accommodate the dimensions of the drill pipe, so the operator may initiate a self-adjusting sequence to allow the operator to change the pipe size of the spinner 100. The sequence may be initiated remotely, for example, from an operator's console (not shown).

As shown in FIG. 5, the self-adjusting sequence begins with the spinner 100 being set at its current pipe size. For example, in the implementation depicted in FIG. 5, the pipe size of the spinner 100 is set at a 3 inch. pipe setting. In this setting, the drive motor assembly 400 is clamped to the stationary case member 210 at a location near the rear of the spinner 100. In addition, the upper and lower grip actuators 260, 260 are maintained in their open (extended) position to receive the pipe 602.

After the self-adjusting sequence is initiated, the operator may switch a spinner adjusting switch (not shown) on, for example, the operator's remote console (not shown) to an unclamp position. When the switch is switched to this position, as shown in FIG. 6, a first signal is sent to the motor clamping assembly 450 to disengage the upper and lower rack clamps 452, 456 of the clamping assembly 450 from the upper and lower fixed racks 282, 284 on the stationary case member 210. Simultaneous to the first signal, a second signal is sent to the adjusting actuator 502, which activates the actuator to move from an open (extended) position to a closed (retracted) position. As the adjusting actuator 502 is retracted, the drive assembly 400 is moved forward towards a front end of the elongated opening 218 and slack is created in the roller chain 302 in the back of the roller chain train.

Turning now to FIG. 7, after the drive assembly 400 is unclamped and moved forward, the roughneck is moved forward toward the center of the oil well and the spinner 100 is pushed forward towards the drill pipe 602 by a push cylinder on its mount. As the spinner 100 is moved towards the pipe 602, the pipe 602 engages the inverse internal portion of the roller chain 302. As the pipe 602 engages the roller chain 603, the slack in the chain 602 is taken up. A sensor located on the roughneck wrench head is activated when the pipe reaches a certain geometrical relationship to the wrench head. Once activated, the roughneck stops its forward movement.

When the roughneck is stopped, the operator may switch the spinner adjusting switch (not shown) to a center position, which activates the adjusting actuator 502 to move to the actuator towards its open (extended) position. As the actuator 502 is moved to towards its open position, the drive assembly 400 is pushed back along the elongated opening 218 to take up any residual slack in the roller chain 302. After the drive assembly 400 is adjusted, the operator may switch the spinner adjusting switch (not shown) to a clamp position, which energizes the hydraulic motor on the motor clamp assembly 450 to engage the upper and lower rack clamps 452, 456 with the upper and lower fixed racks 282, 284, thus locking the drive motor assembly 400 in place.

Once the drive motor assembly 400 is clamped in place and the pipe 602 has been positioned in the well 610, the operator may engage a spin button (not shown) on the operator's remote console (not shown). As shown in FIG. 8, once the spin button is engaged, hydraulic fluid is sent to the upper and lower grip actuators 260, 262, which change the direction of the actuators from a "pushing" actuation to a "pulling" actuation. As the actuators 260, 262 retract, they move the moving arm case member 240 towards the stationary case member to encircle the pipe 602 with the inverse internal portion of the roller chain 302. As the moving arm case member 240 moves closer towards the stationary case member 210, the stationary and moving arm case members 210, 240 pinch the chain 302 around the pipe 602 to generate a gripping force to hold the pipe 602.

As the stationary and moving arm case members 210, 240 grip the pipe 602, hydraulic pressure is built-up in a hydraulic fluid line (not shown) coupled between the grip actuators 260, 262 and the gear motor 402 of the drive assembly 402. Once the hydraulic pressure reaches a certain pressure, a sequential valve (not shown) coupled in series with the hydraulic fluid line opens to send the flow of hydraulic fluid to the gear motor 402. The hydraulic fluid starts the gear motor 402, which in turn drives the drive sprocket 412 and the pipe 602 begins to spin.

When the operator wants to make a drill string, the operator may spin the pipe 602 until the pipe 602 "shoulders out" with the adjoining pipe section (i.e., the threaded ends of the connecting pipe sections are fully engaged). When a pipe shoulders out, the spinner 100 cannot spin the pipe anymore and the gear motor just stalls out. At that point, the operator may disengage the spin button, which cuts off the flow of hydraulic fluid going to the gear motor 402, and the inverse flow of hydraulic fluid routed to the gear motor 402 will be routed to the grip actuators 260, 262 to reverse the direction of the actuators back to their original open (extended) position. As the grip actuators 260, 262 are returned back to their open position, the grip on the pipe 602 is loosened and the operator can remove the spinner from the drill string.

In the converse, when the operator wants to break a drill string, the operator may spin the pipe 602 until the operator hears a rattling of the disengaged threaded portions of the adjoining pipe sections. At that point, the operator may disengage the spin button and remove the top pipe section from the roughneck.

In one implementation of an embodiment of the present invention, a pneumatic control system may be used to send air signals to the hydraulic components. For example, an air-piloted directional control valve may be used to control the (push or pull) direction of the grip actuators 260, 262. In this example, if the operator wants to extend the grip actuators, an air signal may be sent to one side of the directional valve. In the alternative, if the operator wants to retract the grip actuators, an air signal may be sent to the other side of the directional valve.

The foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. An extendable arm holding a pipe spinner, the extendable arm having two ends and a transfer joint positioned between the two ends, where one end pivotally connects to a vertical translator and the other end pivotally connects to a structural frame holding the pipe spinner, where the pivotal connections between both the extendable arm and the vertical translator and the extendable arm and the structural frame allows the pipe spinner to move towards and away from the vertical translator, and where the extendable arm includes at least one piston extending between the vertical translator and the transfer joint for actuating the extendable arm such that the pipe spinner can move towards and away from the vertical translator.

2. The extendable arm of claim 1, where the extendable arm further includes at least one piston extending between the structural frame holding the pipe spinner and the transfer joint.

3. The extendable arm of claim 1, where the at least one piston is a cylindrical piston.

4. The extendable arm of claim 1, the extendable arm further having at least one pivotal joint located between the two ends of the extendable arm.

5. The extendable arm of claim 1, where the vertical translator is configured to move the structural frame up and down relative to a drill string.

6. The extendable arm of claim 1, where the structural frame carries a wrench assembly.

7. An extendable arm holding a pipe spinner, the extendable arm having two ends and a transfer joint positioned between the two ends, where one end connects to a vertical translator and the other end connects to a structural frame holding the pipe spinner, where the extendable arm includes at least one piston extending between the structural frame holding the pipe spinner and the transfer joint for actuating the extendable arm such that the pipe spinner can move towards and away from the vertical translator.

8. The extendable arm of claim 7, the extendable arm further having at least one pivotal joint located between the two ends of the extendable arm.

9. The extendable arm of claim 7, where the at least one piston is a cylindrical piston.

10. The extendable arm of claim 7, where the vertical translator is configured to move the structural frame up and down relative to a drill string.

11. The extendable arm of claim 7, where the structural frame carries a wrench assembly.

12. An extendable arm holding a pipe spinner, the extendable arm having two ends and a transfer joint positioned between the two ends, where one end connects to a vertical translator and the other end connects to a structural frame holding the pipe spinner, where the extendable arm includes a first piston extending between the structural frame holding the pipe spinner and the transfer joint and a second piston extending between the vertical translator and the transfer joint, where both the first and second pistons actuate the extendable arm such that the pipe spinner can move towards and away from the vertical translator.

* * * * *